US007226340B2

(12) United States Patent
Kopp et al.

(10) Patent No.: US 7,226,340 B2
(45) Date of Patent: Jun. 5, 2007

(54) GRINDING MACHINE

(75) Inventors: Viktor Kopp, Erftstadt (DE); Wilfried Saxler, Bruhl (DE)

(73) Assignee: Alfred H. Schutte GmbH & Co. KG, Cologne (DE)

( * ) Notice: Subject to any disclaimer, the term of this patent is extended or adjusted under 35 U.S.C. 154(b) by 37 days.

(21) Appl. No.: 11/072,826

(22) Filed: Mar. 4, 2005

(65) Prior Publication Data

US 2005/0197049 A1 Sep. 8, 2005

(30) Foreign Application Priority Data

Mar. 5, 2004 (DE) ..... 10 2004 011 383
Feb. 10, 2005 (DE) ..... 10 2005 006 242

(51) Int. Cl.
*B24B 49/00* (2006.01)

(52) U.S. Cl. ..... 451/11; 451/9; 451/10; 451/241; 451/246

(58) Field of Classification Search ..... 451/9, 451/10, 11, 14, 24, 241, 242, 246
See application file for complete search history.

(56) References Cited

U.S. PATENT DOCUMENTS 4,276,723 A 7/1981 Herrscher et al.
4,439,951 A * 4/1984 Oppelt et al. ..... 451/194
4,580,370 A * 4/1986 Smith ..... 451/49
4,930,265 A * 6/1990 Belthle ..... 451/11
5,245,793 A * 9/1993 Schmitz ..... 451/49
5,323,572 A * 6/1994 Guenin ..... 451/21
5,667,432 A 9/1997 Rollier
5,674,106 A * 10/1997 Cheetham ..... 451/8
5,865,667 A 2/1999 Rollier
6,190,242 B1 2/2001 Herrscher et al.
6,411,861 B1 * 6/2002 Clewes et al. ..... 700/164
6,852,006 B1 * 2/2005 Gleason et al. ..... 451/11

FOREIGN PATENT DOCUMENTS

DE 4116873 A1 11/1992
DE 198 55 197 A1 10/1999

* cited by examiner

*Primary Examiner*—Elleen P. Morgan
(74) *Attorney, Agent, or Firm*—Fay Sharpe LLP

(57) ABSTRACT

The grinding machine (10) according to the invention serves in particular for the machining or production of tools. It comprises a machine bed 11 and a workpiece spindle (14) arranged thereon, which receives the workpiece (13) to be machined, as well as a grinding station (19) arranged next to the workpiece, the station having a grinding spindle for the reception of a grinding tool (20), and is provided with a workpiece guide system (23) arranged at the machine bed for the support of the workpiece at the grinding location (21). In order to adjust the workpiece in the region of the grinding location (21) within a very short time exactly into the desired horizontal and vertical position relative to the workpiece spindle axis (22) and to keep it in this position during the machining, the workpiece guide system (23) comprises a workpiece reception (24) and an adjustment device (35, 36), with which the workpiece reception can be adjusted in its height distance and lateral distance from the axis (22) of the workpiece spindle (14) or the workpiece clamped therein.

16 Claims, 4 Drawing Sheets

Fig.1
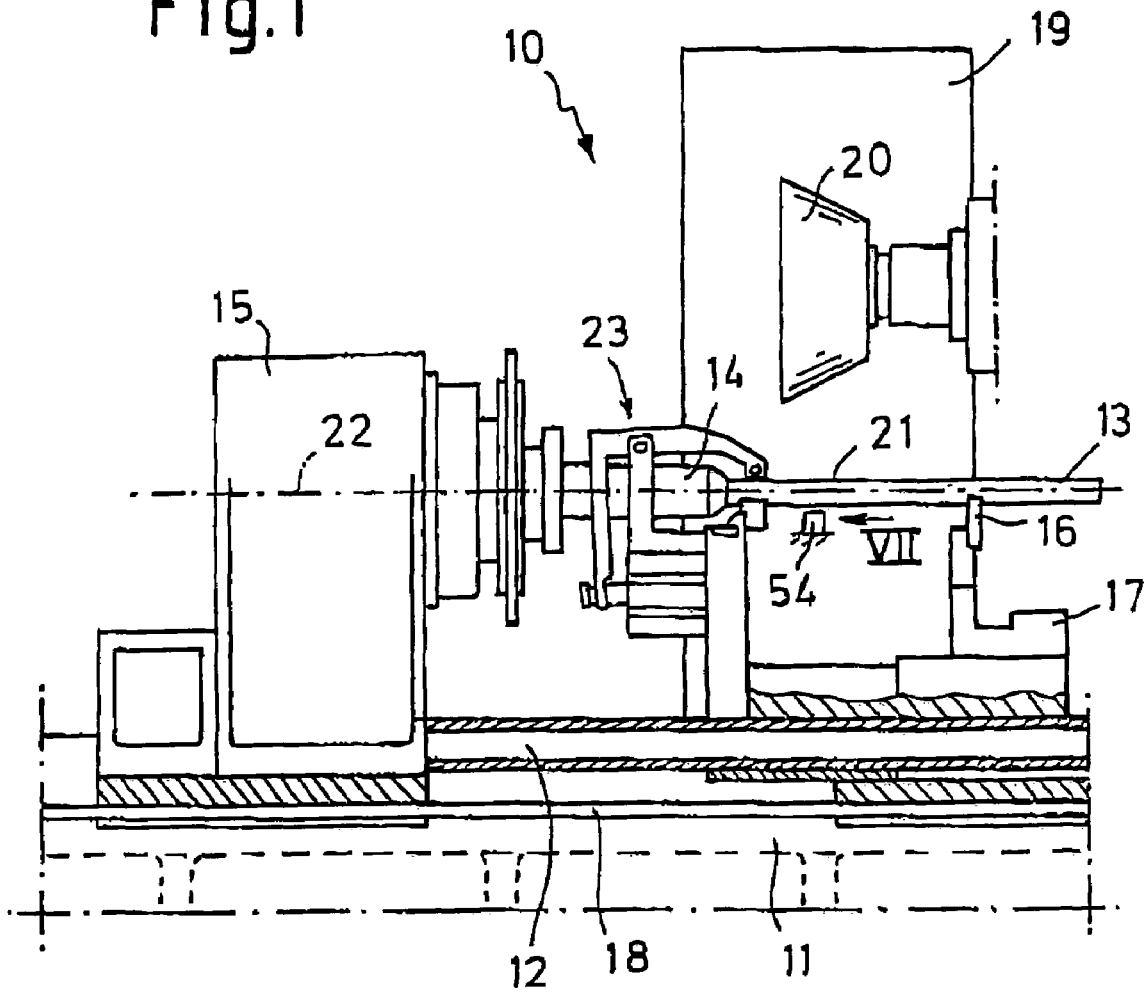
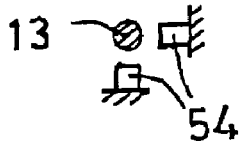
Fig.7

23
25
24
30
34
28
32
35
12
13
14
15

GRINDING MACHINE

REFERENCE TO RELATED APPLICATION

This application claims priority to and the benefit of German Patent Application Nos. 10 2004 011 383.1, which was filed Mar. 5, 2004; and 10 2005 006 242.3, which was filed Feb. 10, 2005, the entirety of which are hereby incorporated by reference.

FIELD OF THE INVENTION

The invention relates to a grinding machine, in particular for machining tools, with a machine bed and a workpiece spindle arranged thereon for machining the workpiece, and with a grinding station arranged next to the workpiece with a grinding spindle for the reception of a grinding tool, and with a workpiece carrier arranged at the grinding location on the machine bed for the support of the workpiece. The invention is further directed to a method for adjusting a tool carrier provided with such a grinding machine.

BACKGROUND OF THE INVENTION

A grinding machine of the type to which the invention relates is for example known from U.S. Pat. No. 6,190,242. With this known grinding machine, the workpiece carrier supporting the workpiece at the grinding location is a back rest or a stationary support which prevents, in particular with an elongated workpiece, that this bends during the machining at the grinding location.

It has been found that the adjustment of such a workpiece carrier generally needs a lot of time and experience. In particular, in cases in which the workpieces are to be ground, the diameter of which are very small compared to their length, for example during the production of boring or milling workpieces with a diameter of only 1 mm or even smaller, the exact positioning of the workpiece carrier necessary for the accurate machining of the workpiece can require a long adjustment time in the region of the grinding location, during which one cannot work with the machine. While such long setting periods can be acceptable with workpieces to be produced in large quantities, they are particularly undesired if only a few workpieces are to be produced with the machine adapted once, before it is converted again.

SUMMARY OF INVENTION

It is the primary object of the invention to provide a grinding machine of the above-mentioned type with which a fast and very accurate adjustment of the workpiece carrier for the support of the workpiece at the grinding location is possible. Accordingly, the method according to the invention shall provide for a particularly precise, easy and quick adjustment of the tool carrier. According to the invention, this object is achieved by the grinding machine in that the workpiece carrier is developed as a workpiece guide system (WGS), which comprises a workpiece reception and an adjustment device with which the workpiece reception can be adjusted in its height displacement and lateral displacement from the axis of the workpiece spindle or the workpiece which is clamped therein.

With the help of the adjustment device, the workpiece reception of the workpiece guide system can be exactly adjusted in two axes transversely to the longitudinal axis of the workpiece spindle, so that it is achieved with little effort in a short time that the workpiece to be machined is supported in the workpiece reception exactly at the desired height and lateral position at the grinding location. That is, it is not necessary anymore to adjust the entire workpiece carrier relative to the machine bed in the height and lateral position as in the state of the art, but only the workpiece reception is adjusted upwards or downwards or transverse, i.e. sideways to the longitudinal axis of the workpiece with the help of the adjustment device. The secondary process times or setting periods of the machine can thereby be shortened considerably during the adjustment.

The workpiece reception, preferably comprises a support prism located approximately opposite to the contact region between the workpiece and the grinding tool and a pressure element for the workpiece which can be abutted against it from the opposite side. That is, the workpiece is then enclosed in the workpiece reception by the support prism on the one hand and the pressure element on the other hand, whereby it stays in contact with the workpiece reception at at least three points and consequently always stays in the same axial orientation even with large forces acting between the workpiece and the grinding tool.

It is of particular advantage if the workpiece guide system is arranged in a moveable manner at the machine bed relative to the workpiece spindle or the workpiece clamped therein. Thereby, the workpiece guide system essentially keeps its position relative to the grinding spindle. It is then possible to machine an elongated workpiece in the grinding machine, whereby either the workpiece spindle with the workpiece clamped therein, and possibly a support receiving the free end of the workpiece moves along the machine bed, while the grinding spindle and the workpiece guide system keep their position relative to the machine bed, or the workpiece spindle and possibly the support are driven along the machine bed together with the workpiece guide system and the workpiece is thereby machined along its length.

The adjustment device can comprise a horizontal and a vertical adjustment control element each for the workpiece reception. In a particularly simple embodiment of the invention, the control elements can essentially consist of set screws, but the control elements can also be an electric NC adjustment drive. It has proved to be particularly advantageous when the adjustment device comprises a solid bearing with adjustment possibilities in the vertical and horizontal direction, whereby the control elements engage the adjustable parts or regions of the solid bearing or act thereon. Such solid bearings find use in different technical areas, where it is important to accomplish even small deflections free from play with very high accuracy.

It is convenient if the support prism and the pressure element are arranged at the same carrier body of the workpiece guide system. The pressure forces acting on the workpieces present between the support prism and pressure element thereby do not influence the height and lateral adjustment of the workpiece reception, as the distribution of forces arising between the two parts is outside this displacement of the workpiece reception.

The pressure element can essentially be formed by a pivoted lever with a pressure surface, which is mounted in a jointed manner to the workpiece reception or its carrier body. A swivel drive can thereby be assigned to the pivoted lever, which drive opens or closes the pressure element by pivoting the pivoted lever. The swivel drive can for example be a hydraulic, pneumatic or electric drive and can load the pressure surface of the pivoted lever against the action of a reset control element as for example a spring in the direction towards the support prism.

It is advantageous if the workpiece reception comprises at least an exchangeable prism element. By the exchange of the prism element, the workpiece reception can be optimally adapted to different workpiece diameters.

A particularly advantageous embodiment of the invention results if sensors are provided which sense the actual position or eccentricity of the workpiece in the region of the grinding location and/or the free workpiece end. The measured values determined by the sensors can for example be made visible on displays and can thereby show the person adjusting the machine by which amount the workpiece reception has to be adjusted upwards or downwards or transversely so that the workpiece is supported in the exactly desired position in the region of the grinding location. In a particularly advantageous further development of the invention, the sensors can be components of a control circuit which controls the adjustment of the control elements in dependence of the measured values sensed by the sensors, whereby an automatically correct adjustment of the workpiece guide system can be achieved.

With the invention, a method is provided for adjusting a workpiece steady at a grinding machine having a workpiece spindle and a grinding station comprising a grinding tool, in which the workpiece steady serves for the support of the workpiece being received in the workpiece spindle, whereas the workpiece steady is formed as a workpiece guide system comprising a workpiece reception and an adjustment device, the workpiece reception being adjustable vertically and laterally with respect to the axis of the workpiece spindle or the workpiece clamped therein with the adjustment device, wherein the workpiece reception comprises a workpiece support block being arranged approximately opposite a contact region between the workpiece and the grinding tool, in which said support block is being calibrated prior to its vertical and lateral adjustment by grinding at least one support area provided at the support block with the grinding tool by a relative movement between the support block and the grinding tool in a direction being parallel to the axis of the workpiece spindle. That is, the support block can be pushed along the guidance which is parallel to the workpiece spindle axis towards the grinding disk which then grinds the support area(s) on the top side of the support block, or the grinding tool is moved in opposite direction towards the support block to grind the support area. By the calibrating grinding, the support block receives at least one support area for the workpiece which support area is exactly parallel to the axis of the workpiece spindle, so that in the following adjustment of the correct vertical and lateral position of the workpiece guiding system the workpiece will have line contact, e.g. contact over the length of the support area, with the support block and by this will have a very stable and exact support.

It is advantageous if the support block is provided with two support axes being arranged under an angle to form an approximately v-shaped groove and that the two support areas are simultaneously grinded with the same grinding tool, so that after the correct adjustment the workpiece will be guided between two contact lines being parallel with each other.

After the calibrating grinding operation the workpiece receptor can be moved into a position in which the support block is positioned near the workpiece spindle and the workpiece receptor can then be adjusted vertically and laterally with the adjustment device until the workpiece clamped in the workpiece spindle is in line contact with the support area(s) of the support block.

It is particularly easy to adjust the workpiece receptor, if the workpiece receptor is provided with a pressure element for the workpiece which pressure element is abutable against the support block and if the adjustment in vertical and lateral directions is accomplished in the closed position of the pressure element, in which the workpiece is clamped between the pressure element and the support block. In this connection, it is possible to proceed in such a way that the distance between the pressure element and the support block or its support area(s) respectively in the clamped position of the workpiece is detected with a sensor element and that the adjustment is terminated once the minimal distance has been reached. Here, one makes use of the fact that the workpiece is in line contact with the support area(s) of the support block once this has been adjusted correctly and that in this position of the workpiece the distance of the pressure element from the support block is the smallest possible which is determined by the diameter of the workpiece.

BRIEF DESCRIPTION OF THE DRAWINGS

Further characteristics and advantages of the invention result from the following description and the drawings, with preferred embodiments of the invention being explained in further detail with examples, wherein:

FIG. 1 illustrates a grinding machine according to the invention schematically in a side view and partially in section;

FIG. 7 illustrates the arrangement of the sensors to be used in the preferred embodiment in a simplified view along VII in FIG. 1.

DETAILED DESCRIPTION OF THE INVENTION

Figure 2:
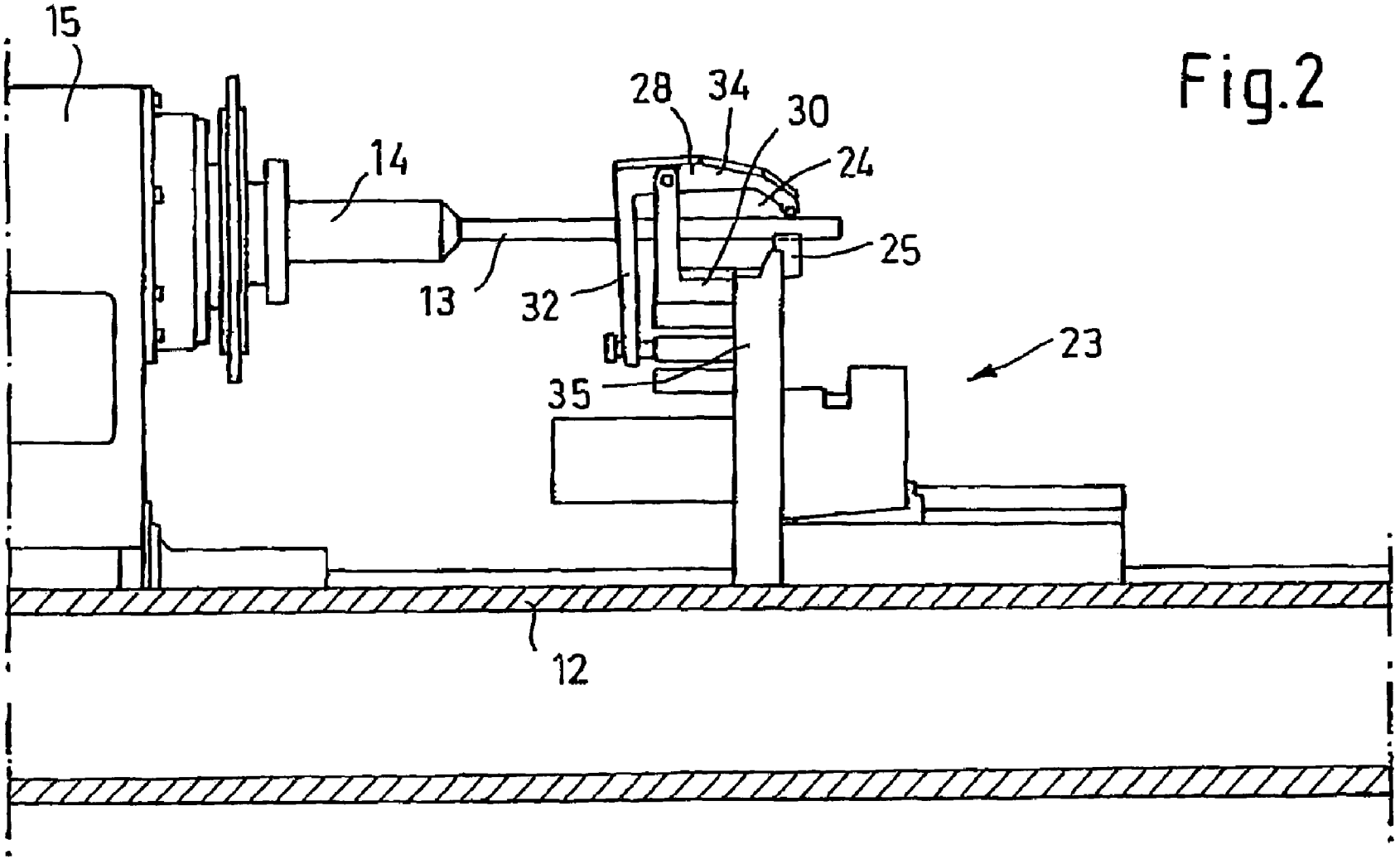
FIG. 2 illustrates a detail of the grinding machine according to FIG. 1 in the region of the workpiece guide system.

The grinding machine 10 shown schematically from the side in FIG. 1 comprises a machine bed 11 with a guide 12, which, in the longitudinal direction, runs parallel to a workpiece 13 to be machined.

The workpiece 13 is clamped with its tail end into a workpiece spindle 14 which can be displaced longitudinally together with its headstock 15 along the guide 12 of the machine bed 11. The other end of the workpiece 13 (to the right in FIG. 1) is supported by a support prism 16 of a support 17, which is also mounted in a longitudinally displaceable manner on the guide 12 and which can be displaced together with the headstock 15. To this end, the headstock 15 and the support 17 are connected to one another by means of a coupling rod 18 with a variable distance.

For the machining of the workpiece 13, the grinding machine 20 comprises a grinding station 19 situated in the drawing plane according to FIG. 1 behind the workpiece 13 with a grinding tool 20 received in the grinding spindle, which can be delivered in different grinding positions in the direction towards the workpiece 13 and machines it, while the workpiece 13 is rotated by the workpiece spindle 14. The mode of operation of such universal grinding machines is known and shall not be explained in detail here.

The workpiece 13 comprises only a small diameter compared to its length. In order that the slim workpiece 13 cannot evade during its machining in the region of the grinding location 21, but preferably rotates exactly coaxially to the axis 22 of the workpiece spindle 14 without any eccentricity, a workpiece guide system (WGS) 23 is arranged in the region of the grinding location 21 at the guide 12 of the machine bed 11, which system is only shown very schematically in FIG., 1, but the details of which can easily be seen from FIGS. 2 to 6.

As will be appreciated by FIGS. 2 to 6, the workpiece guide system 23 comprises a workpiece reception 24 which has a support prism 25 for the workpiece 13 and a pressure element 26 which can be abutted against the workpiece 13, which presses the workpiece 13 in the pressure condition tightly against the two inclined bearing surfaces 27 of the support prism 25, but without obstructing the rotation of the workpiece 13 by the workpiece spindle 14.

The pressure element 26 is part of a pivoted lever 28 which is abutted against the workpiece 13 or is lifted therefrom, whereby it is mounted in a pivoted manner around an axis 29 at a carrier body 30 of the workpiece reception 24, at which the support prism 25 is also located. A pneumatic cylinder 31 arranged in the carrier body 30 serves for the actuation of the pivoted lever 28 in the pressure direction against the workpiece 13, which cylinder 31 presses against the downwardly curved actuation end 32 of the pivoted lever 28 and thereby effects the abutment of the pressure element 26 against the workpiece 13 lying in the support prism 25. In order to again lift the pivoted lever 28 with the pressure element 26 from the workpiece 13 to release this, the pneumatic cylinder 31 is switched without pressure and the actuation end 32 of the pivoted lever 28 is then drawn back by a return spring 33 against the carrier body 30, whereby the pressure end 34 of the pivoted lever 28 lifts from the workpiece 13.

As can further be seen from the drawings, the carrier body 30 is flanged to a solid bearing 35, which forms an adjustment device together with control elements 36 provided thereon, with which the workpiece reception 24 essentially consisting of the carrier body 30, support prism 25 and pressure element 26 can be adjusted in its height distance and lateral distance from the axis 29 of the workpiece spindle 24 or the workpiece 13 clamped therein. For this, the solid bearing 35 is provided with a first, larger cutout 37 in its lower region, which is limited laterally by two small vertical webs 38. Laterally next to one web 38 is arranged a strongly dimensioned vertical abutment 40, which carries one of the control elements in its upper region with which a connecting body 42 of the solid bearing, which is connected via the two vertical webs 38 with a mounting flange 41, can be moved to and fro transversely to the longitudinal axis of the workpiece spindle 14 in a horizontal plane, that is, in FIG. 1, into the drawing plane or out of it. For a displacement in the vertical direction transverse to the longitudinal axis of the workpiece spindle 14, a second, slightly smaller cut-out 43 is provided in the solid bearing 35 in a similar manner, which is limited by a lower and an upper small web 44 or 45, which run horizontally. Below the lower web 44 is located a horizontal abutment 47 with a distance of a small gap 46, which abutment 47 comprises the other control element 36, with which the carrier body 30, which is flanged to the connecting body in the upper region of the solid bearing 35 can be moved downwards or upwards.

Figure 3:
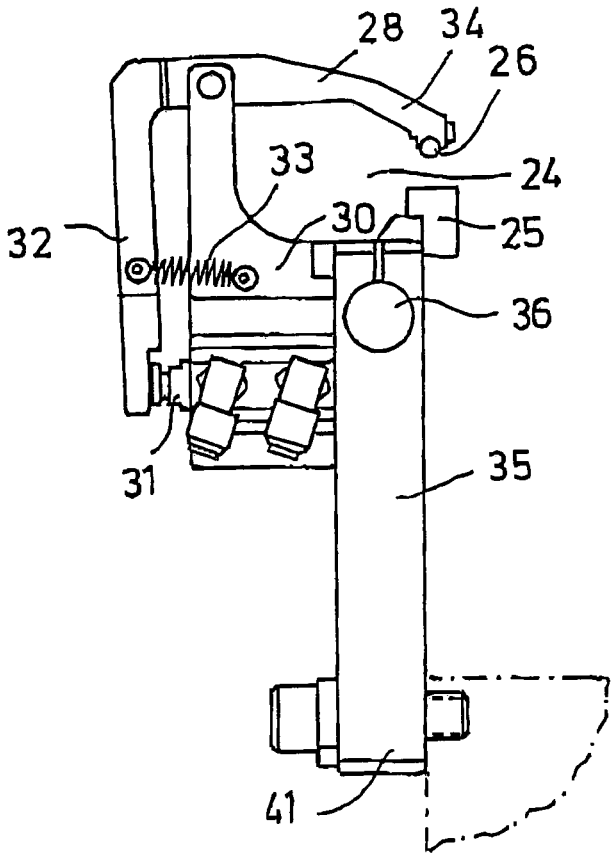
FIG. 3 illustrates a first embodiment of the workpiece guide system of the grinding machine according to the invention in a side view.
Figure 4:
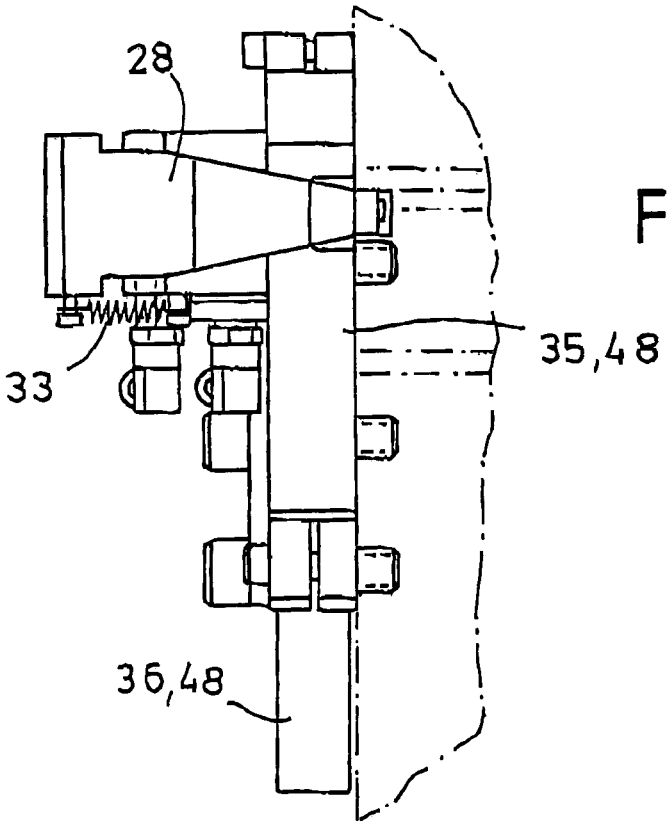
FIG. 4 illustrates the object of FIG. 3 in plan view.
Figure 5:
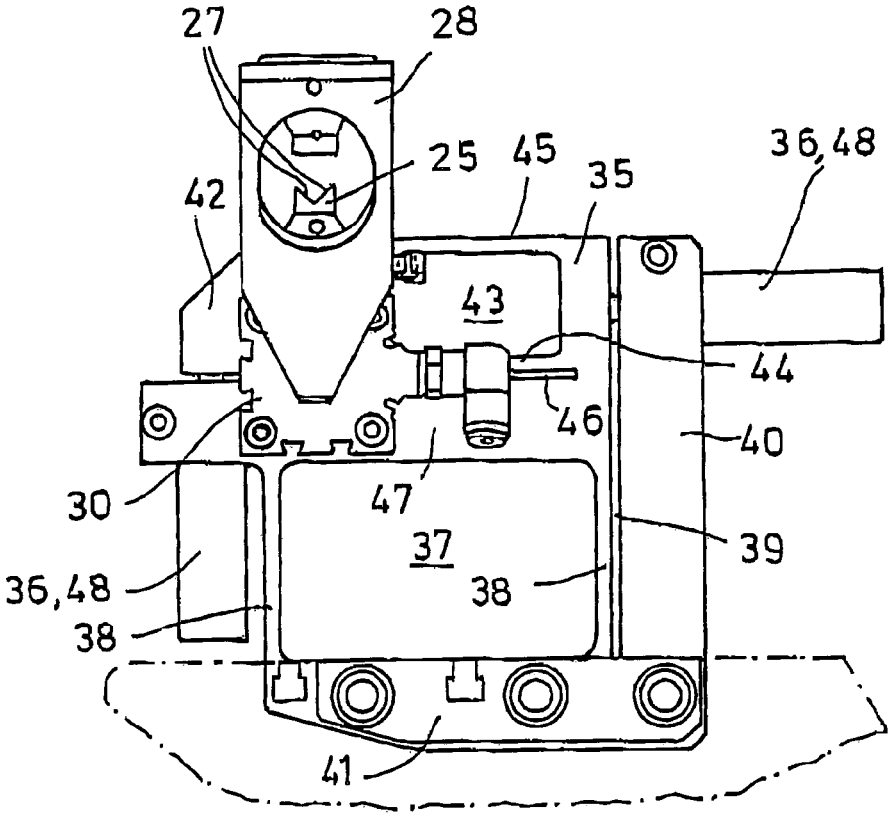
FIG. 5 illustrates the object of FIGS. 3 and 4 in a front view.
Figure 6:
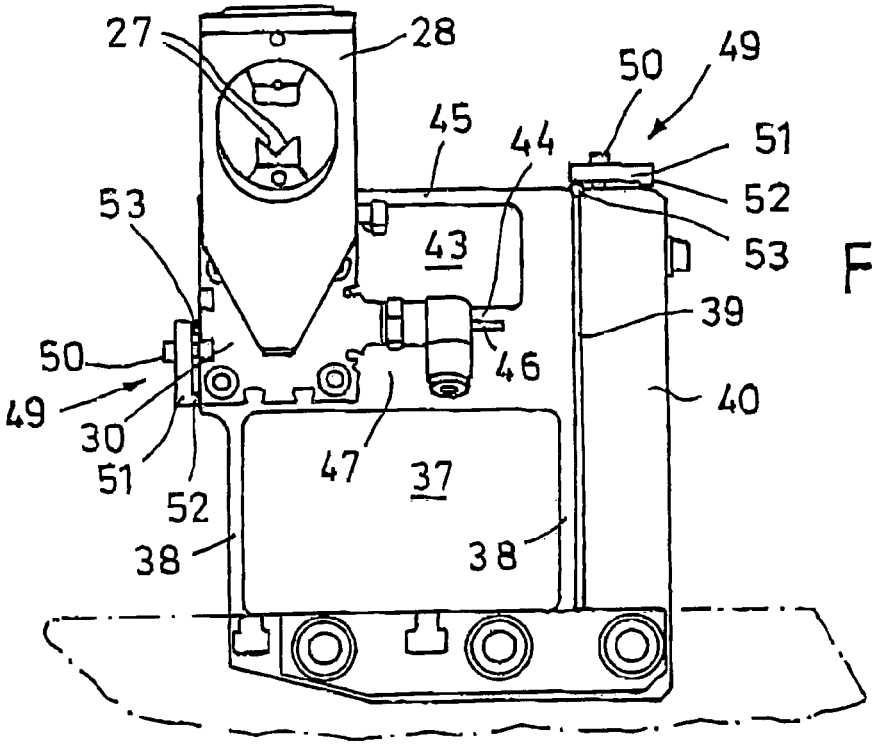
FIG. 6 illustrates a second embodiment of the workpiece carrier of the grinding machine according to the invention in a depiction corresponding to FIG. 5.

In the embodiment shown in FIGS. 3 to 5, the control elements are piezo-electric drives 48 which are displaced electrically due to an actuating signal. In contrast to this, the displacement of the workpiece reception 24 in the horizontal and vertical direction takes place manually in the embodiment shown in FIG. 6, For this, the vertical abutment 40 at its upper free end and the horizontal abutment 47 at its lateral free end are provided with adjustment means 49, which essentially each consist of a set screw 50 having a differential thread and a swivel pressure plate 51, which supports itself at the abutment 40 or 47 with a swivel base 52 and which presses against a pressure cylinder 53 with its free end, the diameter of which is larger than the width of the gaps 39 or 46, so that it is guided between the two upper or lateral edges of these gaps, without being able to slide into the corresponding gap. By this arrangement, a very sensitive adjustment of the solid bearing 35 in the horizontal as well as in the vertical direction is possible, by screwing the corresponding set screw into the associated abutment or out of it, whereby the swivel pressure plate 51 presses onto the pressure cylinder 53 with a larger or lesser amount, and this consequently widens the corresponding gap or relaxes it again, and thereby effects a displacement of the workpiece reception 24 transversely to the axis of the workpiece 13.

It can be seen that, by the arrangement of the support prism 25 and the pressure element 26 acting on this or the workpiece 13 located in the support prism 25 at one and the same carrier body 30, the distribution of forces between these two parts of the workpiece guide system 23 is closed only via the carrier body 30, that is, the inner forces acting in this region are without any influence on the position of the solid bearing 35 or their connecting body relative to the axis of the workpiece spindle 14.

In FIGS. 1 and 7, sensors 54 are schematically indicated in the region of the grinding location 21, with the help of which sensors 54 the actual position or the eccentricity of a workpiece 13 is sensed, Which is newly clamped into the workpiece spindle 14. For this, the sensors 54 are connected to the grinding station 19 in a manner not shown in detail, which relative position to the axis 22 of the workpiece spindle 14 is exactly defined. Before the actual machining of the workpiece 13 the sensors 54 sense the measurement with which the workpiece 13 deviates from the ideal position laterally and in height in the region of the grinding location 21, and produce a corresponding output signal which is evaluated by an evaluation electronic device, not shown. The measurement can then be shown to an operator of the machine 10 in a display, not shown, which then regulates the lateral and height position of the workpiece reception 24 with the help of the control elements 36 in such a manner that the workpiece 13 does not show a deviation from the ideal position in the ideal case. It is also possible to process the signal provided by the sensors 54 to an input signal for the piezoelectric drives 48 of the first embodiment of the workpiece carrier 23 according to FIGS. 1 to 3 and to control the position of the workpiece reception 24 automatically into the correct position through this.

In order to ensure that the workpiece 13 after the adjustment operation is in line contact with the bearing surfaces 27 of the support prism 25 and is therefore supported very exactly, the support prism 25 which is exchangably supported at the workpiece receptor, after its mounting is first grinded in. To this end, the pivoted lever 28 together with the pressure element 26 mounted thereon is dismounted first, so that the support prism 25 which has been rigidly fixed at the workpiece guidance system 23 with its upper side is freely accessible for the grinding tool 20. The grinding disk is than pivoted by 90 degrees with respect to its position as shown in FIG. 1 and is tilted somewhat so that its front side is under the same angle towards a vertical plane as its adjoining conical surface. Next, the workpiece guide system 23 is moved relatively with respect to the rotating grinding tool 20 along the guide 12, whereas the grinding tool 20 grinds the V-shaped groove which is formed by the two bearing surfaces 27. As this grinding of the prism 25 is obtained with a relative movement between the prism 25 and the grinding disk, which movement is exactly parallel to the axis of rotation of the workpiece spindle 14, it is ensured that the groove in the support prism 25 has exactly this alignment and that therefore the workpiece 13 will be supported over the complete length of the groove along two lines of contact, once the position of the workpiece guide system 23 has been correctly adjusted in vertical sense and in a sideway sense.

This adjustment of the workpiece guide system WGS is being done in close proximity of the workpiece spindle, i.e. approximately in a position of the WGS as shown in FIG. 1, whereas the pivot lever 28 is mounted and is engaged against the workpiece which therefore is clamped between the correctly grinded prism and the pressure element. The correct position of the WGS can then be found with the aid of the sensors 54. Alternatively or additionally, it is possible to provide a (further) sensor measuring the distance between the pressure element 26 and the bearing surface(s) 27 of the prism 25. When this distance becomes minimal, this will be an indication that the workpiece 13 lies correctly in the groove provided by the two bearing surfaces 27 and has line contact with these, and that the workpiece guide system 23 is correctly adjusted in this position.

With the invention, it is possible to adjust the workpiece reception 24 with the help of which the workpiece 13 is supported during the machining in the region of the grinding location 21 within a very short period with a high accuracy, whereby the secondary process times during the preparation of the machine 10 for a new workpiece 13 can be kept very short and the production of workpieces 13 having small batch sizes can be executed in an economic manner. With the help of the workpiece guide system 23 according to the invention, it is also possible to manufacture workpieces 13 with a very small diameter and a relatively large length. Thereby, the use of the support 17 can be foregone in many cases, as the relative position of the workpiece 13 to the grinding spindle necessary for the accuracy of the machining is ensured by the workpiece reception 24 guiding the workpiece 13 accurately in the region of the grinding location 21, which reception can be adjusted very accurately and in a very short time with the help of the control elements 36.

The invention claimed is:

1. A grinding machine, in particular for machining workpieces of small diameters compared to their respective lengths, the grinding machine comprising:

a machine bed;

a workpiece spindle arranged on the machine bed receiving the workpiece to be machined and allowing rotation of the workpiece during machining;

a grinding station arranged next to the workpiece having a grinding spindle for the reception of a grinding tool, which is engageable with the workpiece at a grinding location for machining the workpiece; and a workpiece carrier arranged at the machine bed for the support of the workpiece at the grinding location, wherein the workpiece carrier is formed as a workpiece guide system (WGS) which comprises:

a workpiece reception which comprises;

a carrier body;

a support prism at the carrier body comprising bearing surfaces for engaging the workpiece;

a pressure element at the carrier body, the pressure element being movable into a pressure condition and into a release condition, wherein in the pressure condition the pressure element presses the workpiece against the bearing surfaces of the support prism, and wherein in the release condition the pressure element is lifted from the workpiece; and an adjustment device with which the workpiece reception can be adjusted in two axes transversely to the longitudinal axis of the workpiece spindle;

wherein the support prism and the pressure element are arranged at said carrier body such that the distribution of forces between the support prism and the pressure element acting on the workpiece located in the support prism is closed only via the carrier body and not via the adjustment device.

2. A grinding machine according to claim 1, wherein the support prism is located approximately opposite the contact region between the workpiece and the grinding tool of the workpiece.

3. A grinding machine according to claim 2, wherein the workpiece guide system is arranged in a movable manner at the machine bed relative to the workpiece spindle.

4. A grinding machine according to claim 3, wherein the adjustment device comprises a horizontal control element for adjusting the workpiece reception in a horizontal direction and a vertical control element for adjusting the workpiece reception in a vertical direction.

5. A grinding machine according to claim 4, wherein the control elements comprise set screws having differential threads.

6. A grinding machine according to claim 4, wherein the control elements comprise cylinder drives or electrical control element drives.

7. A grinding machine according to claim 6, wherein the adjustment device comprises a solid bearing with adjustable parts connected to the workpiece reception allowing adjustment of the workpiece reception in the vertical and horizontal direction, and wherein the control elements engage the adjustable parts of the solid bearing.

8. A grinding machine according to claim 1, wherein the workpiece guide system is arranged in a movable manner at the machine bed relative to the workpiece spindle.

9. A grinding machine according to claim 1, wherein the adjustment device comprises a horizontal control element for adjusting the workpiece reception in a horizontal direction and a vertical control element for adjusting the workpiece reception in a vertical direction.

10. A grinding machine according to claim 9, wherein the control elements comprise set screws having differential threads.

11. A grinding machine according to claim 9, wherein the control elements comprise cylinder drives or electrical control element drives.

12. A grinding machine according to claim 1, wherein the adjustment device comprises a solid bearing with adjustable parts connected to the workpiece reception allowing adjustment of the workpiece reception in the vertical and horizontal direction, and wherein the control elements engage the adjustable parts of the solid bearing.

13. A grinding machine according to claim 1, wherein the pressure element comprises a pivoted lever with a pressure surface, the pivoted lever being mounted to the carrier body of the workpiece reception in a jointed manner.

14. A grinding machine according to claim 1, wherein the workpiece reception comprises at least one prism element that is exchangeable by another prism element.

15. A grinding machine according to claim 1, wherein comprising sensors sensing an actual position or eccentricity of the workpiece in a region of a grinding location.

16. A grinding machine according to claim 15, wherein the sensors are components of a control circuit which controls the displacement of the control elements according to measured values sensed by the sensors.

* * * * *